US007667167B2

(12) United States Patent
Fitzwater

(10) Patent No.: US 7,667,167 B2
(45) Date of Patent: Feb. 23, 2010

(54) MICROWAVE FOOD HEATING PACKAGE WITH REMOVABLE PORTION

(75) Inventor: Kelly R. Fitzwater, Lakewood, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 119 days.

(21) Appl. No.: 11/567,381

(22) Filed: Dec. 6, 2006

(65) Prior Publication Data

US 2007/0131745 A1 Jun. 14, 2007

Related U.S. Application Data

(60) Provisional application No. 60/748,638, filed on Dec. 8, 2005.

(51) Int. Cl.
*H05B 6/80* (2006.01)
*B65D 5/54* (2006.01)
*B65D 43/00* (2006.01)

(52) U.S. Cl. ..... 219/730; 219/725; 426/109; 426/234; 229/128; 229/242; 229/903; 99/DIG. 14

(58) Field of Classification Search ..... 219/725–735, 219/759, 762; 99/DIG. 14; 426/107, 109, 426/113, 234, 241, 243; 229/101.1, 242, 229/128, 903, 938
See application file for complete search history.

(56) References Cited

U.S. PATENT DOCUMENTS 1,516,090 A 11/1924 Gary et al.
3,240,419 A 3/1966 Spiering et al.
3,324,998 A 6/1967 Farquhar
4,228,945 A 10/1980 Wysocki
4,775,771 A 10/1988 Pawlowski
4,865,921 A 9/1989 Hollenberg
4,890,439 A 1/1990 Smart
4,919,785 A 4/1990 Willey et al.
4,936,935 A 6/1990 Beckett
4,963,424 A 10/1990 Beckett
5,034,234 A 7/1991 Andreas et al.
5,039,364 A 8/1991 Beckett et al.
5,071,062 A 12/1991 Bradley et al.
5,078,273 A 1/1992 Kuchenbecker (Continued)

FOREIGN PATENT DOCUMENTS

DE 203 00 817 U1 4/2003

(Continued)

OTHER PUBLICATIONS

International Search Report—PCT/US2006/046755.

(Continued)

*Primary Examiner*—Quang T Van
(74) *Attorney, Agent, or Firm*—Womble Carlyle Sandridge & Rice, PLLC

(57) ABSTRACT

Various blanks are provided for forming sleeves, containers, and other constructs for heating, browning, and/or crisping of a food item in a microwave oven, and for holding and/or transporting the food item after heating. The various blanks, sleeves, containers, and other constructs include a removable portion defined by one or more lines of disruption that enable the removable portion to be separated from the remainder of the blank, sleeve, container, or other construct.

40 Claims, 3 Drawing Sheets

U.S. PATENT DOCUMENTS

| | | | |
|---|---|---|---|
| 5,096,723 | A | 3/1992 | Turpin |
| 5,117,078 | A | 5/1992 | Beckett |
| 5,213,902 | A | 5/1993 | Beckett |
| 5,221,419 | A | 6/1993 | Beckett |
| 5,260,537 | A | 11/1993 | Beckett |
| 5,266,386 | A | 11/1993 | Beckett |
| RE34,683 | E | 8/1994 | Maynard |
| 5,340,436 | A | 8/1994 | Beckett |
| 5,354,973 | A | 10/1994 | Beckett |
| 5,410,135 | A | 4/1995 | Pollart |
| 5,424,517 | A | 6/1995 | Habeger |
| 5,484,100 | A | 1/1996 | Rigby |
| 5,510,132 | A | 4/1996 | Gallo, Jr. |
| 5,519,195 | A | 5/1996 | Keefer |
| 5,585,027 | A | 12/1996 | Young |
| 5,628,921 | A | 5/1997 | Beckett |
| 5,672,407 | A | 9/1997 | Beckett |
| 5,688,427 | A | 11/1997 | Gallo, Jr. |
| 5,759,422 | A | 6/1998 | Schmelzer |
| 5,800,724 | A | 9/1998 | Habeger |
| 6,063,415 | A | 5/2000 | Walters |
| 6,114,679 | A | 9/2000 | Lai |
| 6,150,646 | A | 11/2000 | Lai |
| 6,204,492 | B1 | 3/2001 | Zeng |
| 6,251,451 | B1 | 6/2001 | Zeng |
| 6,414,290 | B1 | 7/2002 | Cole |
| 6,433,322 | B2 | 8/2002 | Zeng |
| 6,455,827 | B2 | 9/2002 | Zeng |
| 6,552,315 | B2 | 4/2003 | Zeng |
| 6,677,563 | B2 | 1/2004 | Lai |
| 6,683,289 | B2 | 1/2004 | Whitmore et al. |
| 6,717,121 | B2 | 4/2004 | Zeng |
| 6,744,028 | B2 | 6/2004 | Chisholm et al. |
| 6,765,182 | B2 | 7/2004 | Cole |
| 7,414,230 | B2 | 8/2008 | Fitzwater |
| 2003/0080120 | A1 | 5/2003 | Whitmore et al. |
| 2003/0206997 | A1 | 11/2003 | Winkelman et al. |
| 2004/0101605 | A1* | 5/2004 | Sigel ..... 426/394 |
| 2005/0284865 | A1 | 12/2005 | Fogle et al. |
| 2006/0049190 | A1 | 3/2006 | Middleton |
| 2006/0096978 | A1 | 5/2006 | Lafferty et al. |
| 2007/0131742 | A1 | 6/2007 | Fitzwater |
| 2007/0131743 | A1 | 6/2007 | Fitzwater |
| 2007/0131744 | A1 | 6/2007 | Fitzwater |
| 2007/0138247 | A1 | 6/2007 | Fitzwater |

FOREIGN PATENT DOCUMENTS

| | | |
|---|---|---|
| EP | 1 452 458 A2 | 9/2004 |
| FR | 2 516 481 | 5/1983 |
| FR | 2 665 882 | 2/1992 |
| FR | 2 687 384 | 8/1993 |
| GB | 2 365 000 A | 2/2002 |
| WO | WO 2007/067705 | 6/2007 |

OTHER PUBLICATIONS

Written Opinion—PCT/US2006/046755.
International Search Report—PCT/US2008/050578.
Written Opinion—PCT/US2008/050578.

* cited by examiner

MICROWAVE FOOD HEATING PACKAGE WITH REMOVABLE PORTION

CROSS-REFERENCE TO RELATED APPLICATIONS

This application claims the benefit of U.S. Provisional Application No. 60/748,638, filed Dec. 8, 2005, which is incorporated by reference herein it its entirety.

TECHNICAL FIELD

The present invention relates to various blanks, constructs, and methods for heating, browning, and/or crisping a food item, and particularly relates to various blanks, constructs, and methods for heating, browning, and/or crisping a food item in a microwave oven.

BACKGROUND

There is a need for a package or other construct that facilitates transportation and consumption of a food item therein. There further is a need for such a package or other construct that enhances browning and crisping of a food item in a microwave oven.

SUMMARY

The present invention generally is directed to various blanks and sleeves, pouches, packages, and other constructs (collectively "constructs") formed therefrom. The various constructs include one or more features that allow a consumer to access various portions of the food item therein as the food item is consumed. Additionally, any of the constructs of the invention may include features that enhance the browning and crisping of the food item heated therein.

Numerous blanks are contemplated by the invention. Each blank generally comprises a plurality of adjoined panels, each panel having a first dimension extending in a first direction and a second dimension extending in a second direction, where the first direction is substantially perpendicular to the second direction. The various blanks typically include a pair of opposed surfaces. A microwave energy interactive element may overlie at least a portion of at least one of the opposed surfaces. The blank includes a removable portion defined at least partially by a line of disruption.

In one aspect, the blank comprises a plurality of adjoined panels, each having a first dimension extending in a first direction and a second dimension extending in a second direction, a microwave energy interactive element overlying at least a portion of at least one of the plurality adjoined panels, and a removable portion defined by a tear line that extends in the first direction and adjoins a first pair of adjacent panels of the plurality of adjoined panels. In one variation, the tear line is a first tear line, and the removable portion is defined further by a second tear line that extends in the first direction and adjoins a second pair of adjacent panels. The microwave energy interactive element may comprise a susceptor, a foil, a segmented foil, or any combination thereof.

Any of the various blanks may be formed into a sleeve for heating, browning, and/or crisping a food item in a microwave oven, where the sleeve includes a removable portion comprising the removable portion of the blank. In one particular aspect, the sleeve comprises a first main panel and a second main panel in an opposed configuration, a first minor panel and a second minor panel in an opposed configuration, and at least one removable portion defined by at least one tear line that extends in the first direction and adjoins at least one of the first main panel and the second main panel to at least one of the first minor panel and the second minor panel. The first minor panel and the second minor panel are joined to the first main panel and the second main panel along respective fold lines to define an interior space. A microwave energy interactive element overlies at least a portion of at least one of the first main panel, the second main panel, the first minor panel, and the second minor panel.

If desired, the sleeve may be transformed into a container in which the food item can be positioned in an upright configuration for transportation and/or consumption. The container generally may include a pair of opposed main panels, a pair of opposed minor panels joined to the main panels along respective fold lines, and a pair of end panels collectively defining an interior space. The end panels may be folded toward the interior space in a superposed configuration. The container includes one or more removable portions that allow a user to reduce the size of, or alter the shape of, the container, thereby gaining better access to the food item.

For example, in one aspect, the container comprises a first main panel and a second main panel in an opposed configuration, and a first minor panel and a second minor panel in an opposed configuration. The first minor panel and the second minor panel are joined to the first main panel and the second main panel along respective fold lines to define an interior space. A pair of end panels is folded along respective substantially arcuate fold lines toward the interior space in a superposed configuration. The container also includes at least one removable portion defined by at least one tear line that extends in the first direction and adjoins at least one of the first main panel and the second main panel to at least one of the first minor panel and the second minor panel. A microwave energy interactive element may overlie at least a portion of at least one of the first main panel, the second main panel, the first minor panel, and the second minor panel. The container may be positioned in an upright configuration with the food item being supported by the end panels. If desired, the removable portion may be separated at least partially from the remainder of the container to gain improved access to the food item therein.

Other features, aspects, and embodiments will be apparent from the following description and accompanying figures.

BRIEF DESCRIPTION OF THE DRAWINGS

The description refers to the accompanying drawings, some of which are schematic, in which like reference characters refer to like parts throughout the several views, and in which.

DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1A:
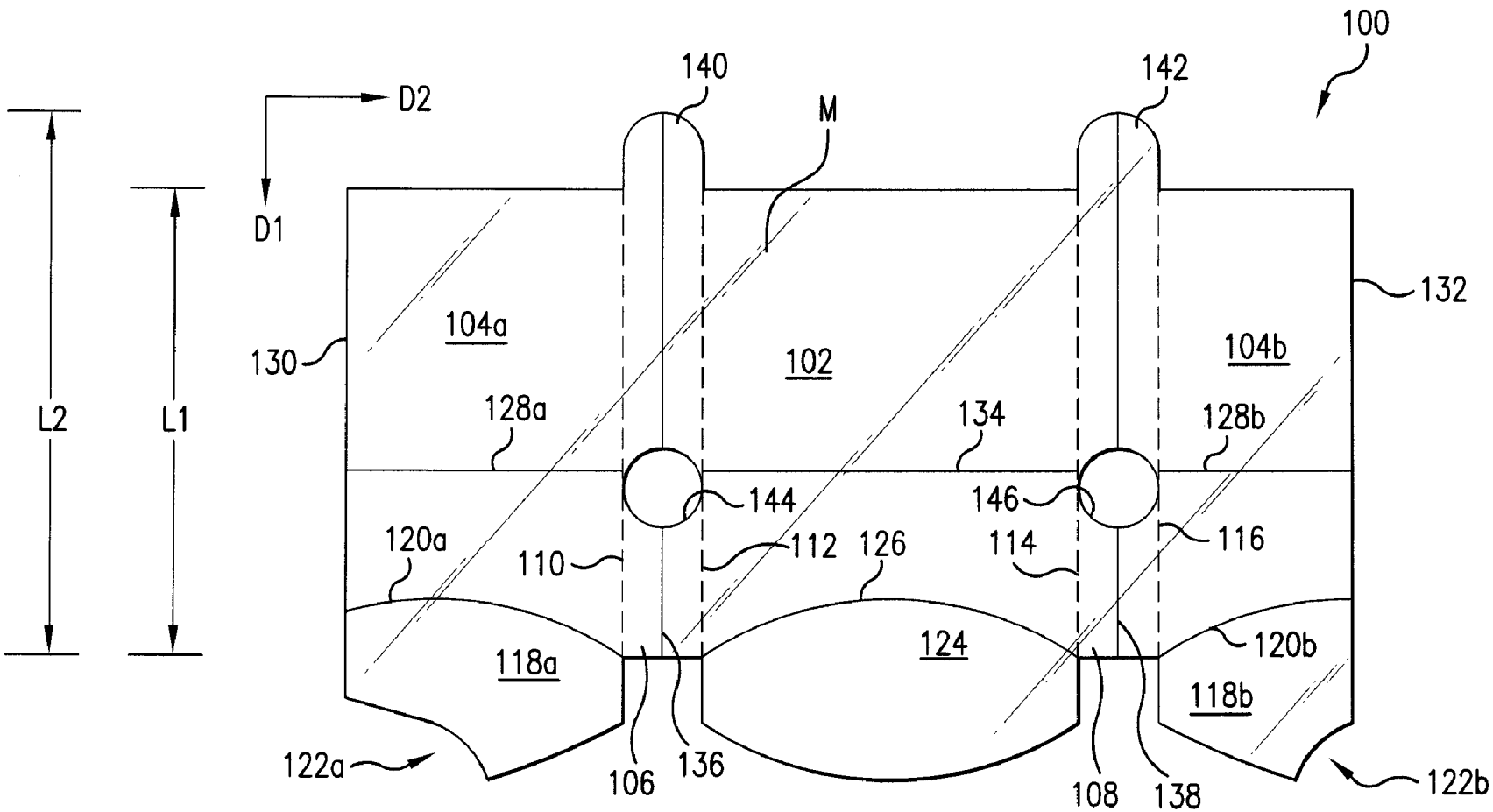
FIG. 1A depicts an exemplary blank according to various aspects of the present invention.
Figure 1B:
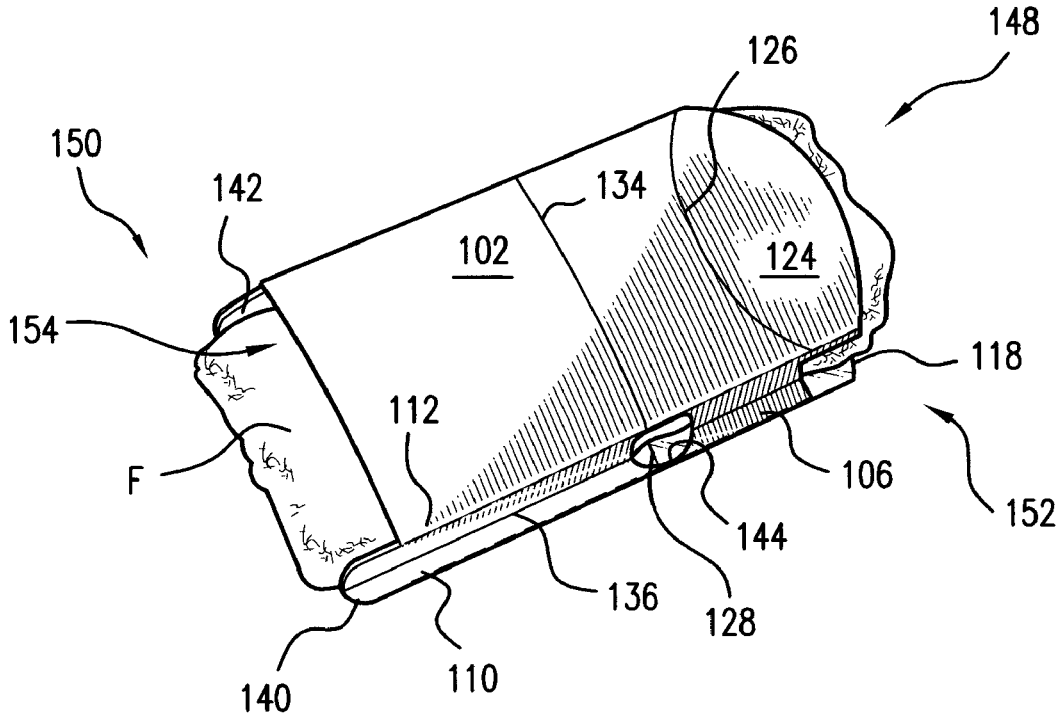
FIG. 1B illustrates the blank of FIG. 1A formed into a sleeve with two open ends, according to various aspects of the present invention.

FIG. 1A depicts an exemplary blank 100 according to various aspects of the present invention. The blank 100 includes a plurality of adjoined panels. Each of the various panels and the blank generally has a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the blank is manufactured or erected into a construct.

The blank 100 generally includes a main panel 102, a first major panel 104*a*, a second major panel 104*b*, a first minor panel 106, and a second minor panel 108. The first minor panel 106 is joined to first major panel 104*a* along a longitudinal tear line 110. The main panel 102 is joined to the first minor panel 106 along a longitudinal tear line 112. The second minor panel 108 is joined to the main panel 102 along a longitudinal tear line 114. The second major panel 104*b* is joined to the second minor panel 108 along a longitudinal tear line 116.

In this example, tear lines 110, 112, 114, and 116 are substantially parallel and substantially equal in length, L1. However, other configurations may be used with the invention. Furthermore, in this example, each of tear lines 110, 112, 114, and 116 are shown in the figures as a plurality of smaller cut lines. However, it will be understood that in this and other aspects of the invention, any type of tear line or other line of disruption may be used to define the removable portion. For example, the line of disruption may include a score line, a cut line, a perforated line, kiss cut line, zigzag cut line, zipper cut line, any other suitable line of disruption, or any combination thereof.

According to various aspects of the invention, one or more of panels 102, 104*a*, 104*b*, 106, and 108 may serve as a removable portion of the blank 100. Any of such panels may be separated at least partially from an adjacent panel by tearing along at least one of tear lines 110, 112, 114, and 116. For example, first major panel 104*a* may be separated at least partially from the remainder of the blank 100 by tearing along tear line 110. First minor panel 106 may be separated at least partially from the remainder of the blank 100 by tearing along tear line 110 and/or tear line 112. Main panel 102 may be separated at least partially from the remainder of the blank 100 by tearing along tear line 112 and/or tear line 114. Second minor panel 108 may be separated at least partially from the remainder of the blank 100 by tearing along tear line 114 and/or tear line 116. Second major panel 104*b* may be separated at least partially from the remainder of the blank 100 by tearing along tear line 116. As will be shown below, tear lines 110, 112, 114, 116 also serve as fold lines in forming a construct. However, it is contemplated that the removable portion of the blank may be formed or defined by one or more lines of disruption that do not also serve as fold lines.

Still viewing FIG. 1A, partial end panels 118*a* and 118*b* respectively are joined to major panels 104*a* and 104*b* along respective curved fold line segments 120*a* and 120*b*. Partial end panels 118*a* and 118*b* respectively include a partial cutout 122*a* and 122*b*. The blank 100 also includes an end panel 124 joined to the main panel 102 along fold line 126. In this example, the end panel 124 is substantially lentiform in shape. However, the end panel 124 may have any suitable shape. For example, the end panel may be oval, rectangular, square, diamond-shaped, trapezoidal, polygonal, irregular, or may be any other suitable shape. The cutout may be circular, square, or any other regular or irregular shape.

The first and second major panels 104*a* and 104*b* include respectively aligned transverse fold line segments 128*a* and 128*b*. Fold line 128*a* extends between and is substantially perpendicular to edge 130 and tear line 110. Fold line 128*b* extends between and is substantially perpendicular to edge 132 and tear line 116. Likewise, the first major panel includes a transverse fold line 134 extending between and substantially perpendicular to tear line 112 and tear line 114. In the example shown in FIG. 1A, fold lines 128*a*, 134, and 128*b* are in substantial alignment. However, it will be understood that fold line 134 may not be aligned with segments 128*a* and 128*b* if needed or desired. Additionally, any of fold lines 128*a*, 128*b*, and 134 may be tear lines or other lines of disruption if needed or desired.

The first minor panel 106 and the second minor panel 108 include respective fold lines 136 and 138 substantially centrally disposed and extending along the length L2 thereof The first minor panel 106 and the second minor panel 108 also include respective extensions or tabs 140 and 142 that extend beyond panels 102, 104*a*, and 104*b*, such that the overall length L2 of each of minor panels 106 and 108 including respective extensions 140 and 142 is greater than the length L1 of panels 102, 104*a*, and 104*b* (measured at the longest point). In this example, the tabs 140 and 142 are somewhat semi-circular or obround in shape. However, numerous other shapes are contemplated hereby. For example, each tab or extension independently may be triangular, square, rectangular, or any other regular or irregular shape as desired.

Optionally, one or both of the first minor panel 106 and the second minor panel 108 include respective apertures 144 and 146. In the example shown in FIG. 1A, aperture 144 is substantially circular in shape and extends substantially between tear lines 110 and 112. Likewise, aperture 146 is substantially circular in shape and extends substantially between tear lines 114 and 116. However, it will be understood that in this and other aspects of the invention described herein and contemplated hereby, the number, shape, size, and positioning of such apertures may vary for a particular application depending on type of construct being formed from the blank, the food item to be heated therein or thereon, the desired degree of browning and/or crisping, whether direct exposure to microwave energy is needed or desired to attain uniform heating of the food item, the need for regulating the change in temperature of the food item through direct heating, and whether and to what extent there is a need for venting.

Numerous materials may be suitable for use in forming the various blanks and constructs of the invention, provided that the materials are resistant to softening, scorching, combusting, or degrading at typical microwave oven heating temperatures, for example, at from about 250° F. to about 425° F. The particular materials used may include microwave energy interactive materials and microwave energy transparent or inactive materials.

For example, any of the various blanks or constructs of the present invention may include one or more features that alter the effect of microwave energy during the heating or cooking of the food item. For example, the blank or construct may be formed at least partially from one or more microwave energy interactive elements (hereinafter sometimes referred to as "microwave interactive elements") that promote browning and/or crisping of a particular area of the food item, shield a particular area of the food item from microwave energy to prevent overcooking thereof, or transmit microwave energy toward or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs are referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In one example, the microwave interactive element may comprise a thin layer of microwave interactive material, for example, a susceptor, that tends to absorb microwave energy and generate heat at the interface with a food item in intimate or proximate contact therewith. Such elements often are used to promote browning and/or crisping of the surface of a food item (sometimes referred to as a "browning and/or crisping element"). When supported on a film or other substrate, such an element may be referred to as a "susceptor film" or, simply, "susceptor". Where the substrate is a blank, carton, or other construct including a plurality of panels, a susceptor may overlie all or a portion of one or more of the panels, and may form at least a portion of the surface proximate the food item. By way of example, and not limitation, if desired, a susceptor M or other microwave energy interactive element may overlie at least a portion of blank 100 and may form at least a portion of the interior surface of the construct 148 formed therefrom, as shown in FIGS. ID and 1E. However, other microwave energy interactive elements, such as those described herein, are contemplated for use with the invention.

For example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating. The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and/or positioned to heat particular areas of the food item selectively. As stated previously, the number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, whether and to what extent there is a need for venting, and numerous other factors.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy interactive material or, alternatively, may be a portion of the construct formed with a microwave energy interactive material that has been deactivated. While both physical and non-physical apertures allow the food item to be heated directly by the microwave energy, a physical aperture also provides a venting function to allow steam or other vapors to be released from the food item.

It also may be beneficial to create one or more discontinuities or inactive regions to prevent overheating or charring of the construct. By way of example, and not limitation, in the construct 148 illustrated herein, panels 104*a* and 104*b* are overlapped to form a second main panel 104, as will be discussed below. When exposed to microwave energy, the concentration of heat generated by the overlapped panels may be sufficient to cause the underlying support, in this case, paperboard, to become scorched. As such, the overlapping portions of one or both of panels 104*a* and 104*b* may be designed to be microwave inactive, for example, by forming these areas without a microwave energy interactive material or by deactivating the microwave energy interactive material in these areas.

Further still, one or more panels, portions of panels, or portions of the construct may be designed to be microwave energy inactive to ensure that the microwave energy is focused efficiently on the areas to be browned and/or crisped, rather than being lost to portions of the food item not intended to be browned and/or crisped or to the heating environment.

As stated above, any of the above elements and numerous others contemplated hereby may be supported on a substrate. The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Georgia). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pennsylvania). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a water vapor transmission rate as measured using ASTM F1249 of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5221,419; 5,213,902; 5,117,078; 5,039,364; 4,963,420; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form at least a portion of the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions or sides of the various blanks or other constructs described herein or contemplated hereby may be coated with varnish, clay, or other materials, either alone or in combination. For example, at least the side of the support that will form an exterior surface of a construct erected therefrom may be coated with a clay coating or other base coating. The coating may then be printed over with product advertising, images, price coding, any other information or indicia, or any combination thereof. The blank or construct then may be overcoated with a varnish to protect any information printed thereon.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEKTM nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. U.S. 2006/0049190 A1, published Mar. 9, 2006, both of which are incorporated herein by reference in their entirety.

It will be understood that with some combinations of elements and materials, the microwave interactive element may have a grey or silver color that is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

Turning to FIGS. 1B-1E, numerous sequences of steps may be used to form a sleeve or other construct 148 according to the invention. In one example, the blank 100 is folded along fold lines 110, 112, 114, and 116, and edges 130 and 132 are brought towards each other to form a sleeve 148 with two ends 150 and 152 and cavity or interior space 154 therebetween. The first and second major panels 104*a* and 104*b* are overlapped to the extent needed to form a second main panel 104. Partial end panels 118*a* and 118*b* are overlapped to the extent needed to form end panel 118. In this example, the end panel 118 is substantially lentiform in shape, generally resembling a biconvex lens. However, other shapes are contemplated hereby. Fold line segments 120*a* and 120*b* are overlapped as needed to form an arcuate fold line (not shown). Partial cutouts 122*a* and 122*b* are overlapped as needed to form a cutout (not shown). In this example, the cutout is somewhat semicircular in shape. However, it will be understood that numerous other shapes are contemplated hereby. Fold line segments 128*a* and 128*b* may be overlapped as needed to form fold line 128.

The overlapped portions may be glued or otherwise joined. The first minor panel 106 and second minor panel 108 form opposed side walls for the construct 148, which may be gusseted by folding inwardly along respective fold lines 136 and 138.

To use the construct, for example, a food item F is inserted through an end 150 or 152, and the construct 148 with the food item inside is placed into a microwave oven (not shown) to be heated. As the food item is heated, the susceptor M enhances browning and/or crisping of the surface of the food item. It is contemplated that any of the panels, for example, the first main panel 102, the first major panel 104*a*, or the second major panel 104*b*, may include one or more fold lines, score lines, cut lines, cut crease lines, or other lines of disruption along all or a portion of the length or width thereof to accommodate the contours of the particular food item heated therein and to bring the susceptor M into closer proximity with the surface of the food item. Any steam generated during heating may be released through the open ends 150 and 152 of the sleeve, or through apertures 144 and 146.

Figure 1C:
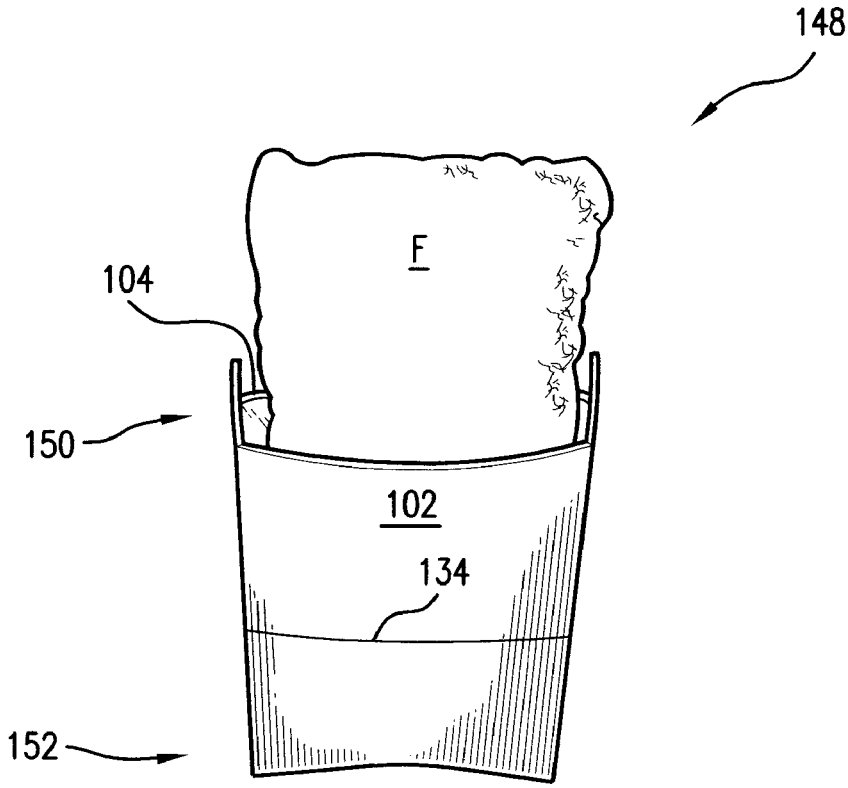
FIGS. 1C-1E illustrate the blank of FIG. 1A formed into a container for carrying a food item therein, according to various aspects of the present invention.

After the item is heated sufficiently, the user may remove the food item from the construct or may, as described above, fold the end panels 118 and 124 toward the interior 154 of the construct 148 to form a construct having one open end 150 and one closed end 152, as shown in FIG. 1C. The construct 148 then may be positioned such that the inwardly folded end panels 118 and 124 serve as a base to support the food item. This provides a convenient means for handling and transporting the heated food item without having to contact the surface of the food item.

Figure 1D:
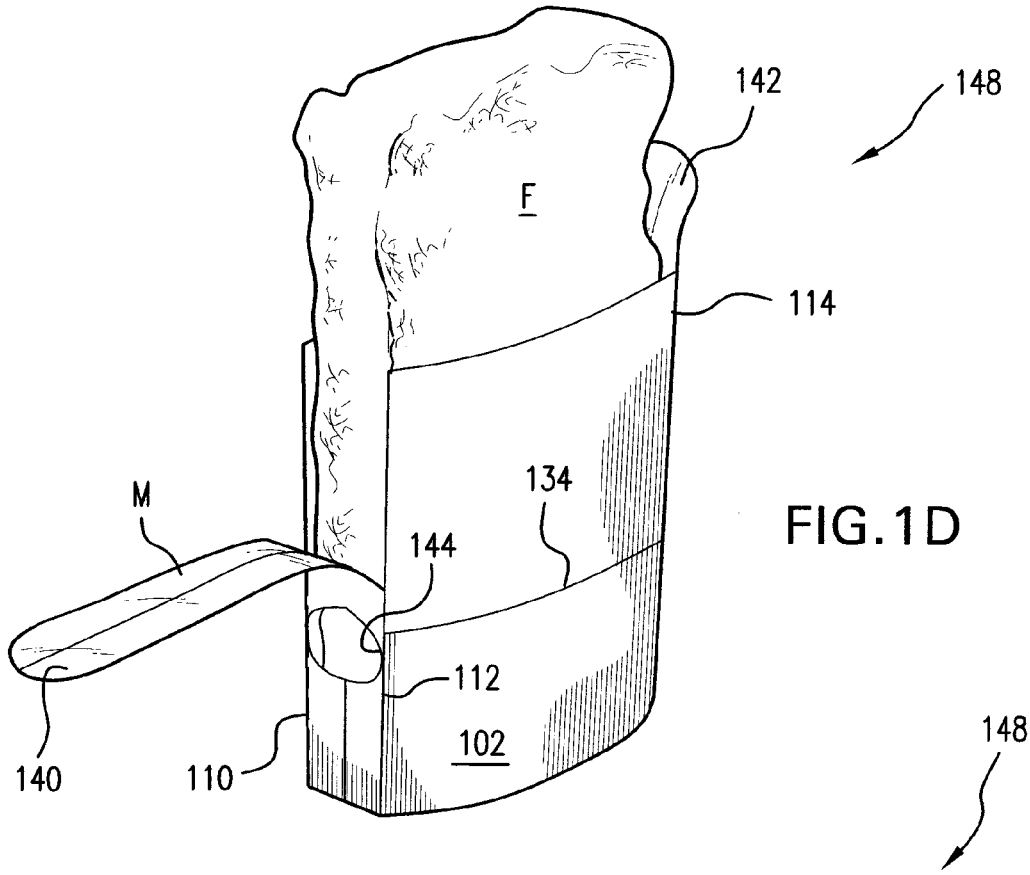
Figure 1E:
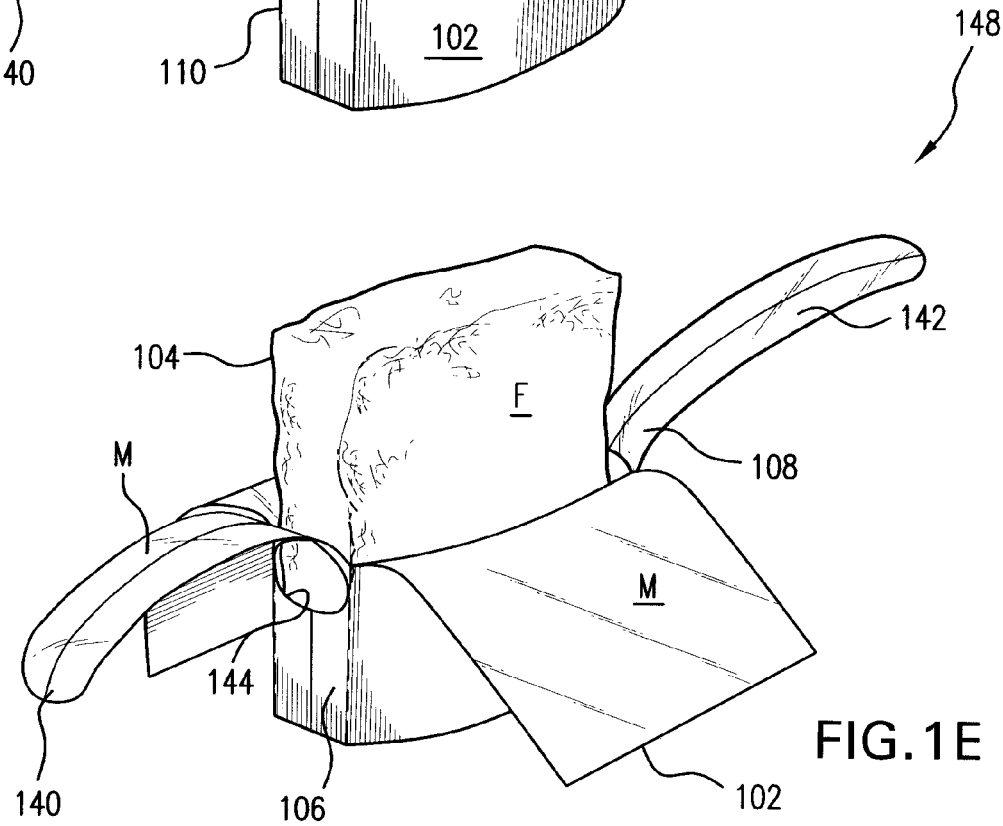

Turning to FIGS. 1D and 1E, as the food item F is consumed, the user may grasp one or both of tabs 140 and 142 and initiate separation of the corresponding minor panels 106 and 108 along the respective tear lines 110 and 112 and/or 114 and 116 from the remainder of the construct 148. In this example, separation of the minor panels 106 and 108 from the construct will cease upon reaching apertures 144 and 146. If additional separation is desired, tearing can be initiated again. As shown in FIG. 1E, one or both of the major panels 102 and 104 may be folded along respective fold lines 128 and/or 134 to improve access to the food product contained within the construct 148. Where one or both of fold lines 128 and 134 are tear lines, such folded portions may be removed if desired. As is apparent from FIG. 1E, the construct facilitates ready access to the food product being consumed.

In this example, one or both of the first minor panel 106 and the second minor panel and 106 may be said to comprise removable portions of the construct. However, it will be understood that one or both of the first main panel 102 and second main panel 104 also may be considered to be the removable portion of the construct, since the various panels are separated along the tear lines adjacent to such panels. Thus, for a given embodiment of the invention, the removable portion may be characterized in numerous different ways, without limitation.

In the examples shown herein, the construct is somewhat rectangular in shape, suitable, for example, for heating a sandwich or breakfast pastry therein. However, it will be understood that in this and other aspects of the invention described herein or contemplated hereby, numerous suitable shapes and configurations may be used to form the various panels and, therefore, constructs. Examples of other shapes encompassed hereby include, but are not limited to, polygons, circles, ovals, cylinders, prisms, spheres, polyhedrons, and ellipsoids. The shape of each panel may be determined largely by the shape of the food item, and it should be understood that different packages are contemplated for different food items, for example, sandwiches, pizzas, French fries, soft pretzels, pizza bites, cheese sticks, pastries, doughs, and so forth. The construct may be flexible, semi-rigid, rigid, or may include a variety of components having different degrees of flexibility. Likewise, the construct may include gussets, pleats, or any other feature needed or desired to accommodate a particular food item and/or portion size. Additionally, it will be understood that the present invention contemplates blanks and constructs for single-serving portions and for multiple-serving portions.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be understood that in each of the various blanks and trays described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness; or any combination of these features.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks can also be referred to as a cut line, since the nicks typically are a relatively small percentage of the subject line, and alternatively the nicks can be omitted from such a cut line.

Furthermore, various exemplary blanks and constructs are shown and described herein as having fold lines, tear lines, score lines, cut lines, kiss cut lines, and other lines as extending from a particular feature to another particular feature, for example from one particular panel to another, from one particular edge to another, or any combination thereof. However, it will be understood that such lines need not necessarily extend between such features in a precise manner. Instead, such lines may generally extend between the various features as needed to achieve the objective of such line. For instance, where a particular tear line is shown as extending from a first edge of a blank to another edge of the blank, the tear line need not extend completely to one or both of such edges. Rather, the tear line need only extend to a location sufficiently proximate to the edge so that the removable strip, panel, or portion can be manually separated from the blank or construct without causing undesirable damage thereto.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the invention as set forth in the following claims.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A blank for forming a construct, comprising:

a plurality of adjoined panels, each panel having a first dimension extending in a first direction and a second dimension extending in a second direction substantially perpendicular to the first direction, the plurality of adjoined panels including a main panel, a first minor panel and a second minor panel respectively joined to opposite edges of the main panel, a first major panel joined to the first minor panel, and a second major panel joined to the second minor panel, wherein each of the main panel, the first minor panel, the second minor panel, the first major panel, and the second major panel are joined respectively to one another along a plurality of respective substantially parallel tear lines extending in the first direction; and a microwave energy interactive element overlying at least a portion of at least one panel of the plurality adjoined panels, wherein the main panel, the first major panel, and the second major panel each have an edge extending in the second direction, the respective edges of the main panel, first major panel, and the second major panels being substantially aligned with one another, and the first dimension of the first minor panel and the second minor panel is greater than the first dimension of the main panel, the first major panel, and the second major panel, such that a portion of each of the first minor panel and the second minor panel extends in the first direction beyond the edge of the main panel, the first major panel, and the second major panel.

2. The blank of claim 1, wherein the respective portion of the first minor panel and the second minor panel that extends beyond the edge of the main panel, the first major panel, and the second major panel has a substantially curved end.

3. The blank of claim 1, wherein the first minor panel and the second minor panel each include a respective fold line extending in the first direction substantially centered within the respective minor panel.

4. The blank of claim 1, wherein the plurality of adjoined panels further includes a substantially lentiform end panel joined to the main panel along a substantially arcuate fold line.

5. The blank of claim 4, wherein the plurality of adjoined panels further includes a first partial end panel joined to the first major panel along a first curved fold line, and a second partial end panel joined to the second major panel along a second curved fold line.

6. The blank of claim 1, further comprising a fold line extending in the second direction substantially across the main panel.

7. The blank of claim 1, further comprising:

a fold line extending in the second direction substantially across the first major panel; and a fold line extending in the second direction substantially across the second major panel.

8. The blank of claim 1, wherein the microwave energy interactive element comprises a susceptor overlying at least a portion of the main panel, the first major panel, and the second major panel.

9. The blank of claim 1, wherein the microwave energy interactive element comprises a susceptor, a foil, a segmented foil, or any combination thereof.

10. The blank of claim 1, wherein the microwave energy interactive element converts at least a portion of impinging microwave energy to thermal energy.

11. A construct for heating, browning, and/or crisping a food item, comprising:

a first main panel and a second main panel opposite one another, the first main panel and the second main panel each having a first end at least partially defining an opening at a first end of the construct, and a second end at a second end of the construct;

a first minor panel and a second minor panel opposite one another, the first minor panel and the second minor panel being joined to the first main panel and the second main panel along respective tear lines to at least partially define an interior space, wherein the first minor panel and the second minor panel extend upwardly from the opening to define a pair of tabs;

a first end panel foldably joined to the second end of the first main panel;

a second end panel foldably joined to the second end of the second main panel, the first end panel and the second end panel being foldably joined to the first main panel and the second main panel along respective arcuate fold lines; and a microwave energy interactive element overlying at least a portion of at least one of the first main panel, second main panel, first minor panel, and second minor panel on a side of the respective panel facing the interior space.

12. The construct of claim 11, further comprising a fold line extending across at least one of the first main panel and the second main panel substantially between the first minor panel and the second minor panel, the fold line defining a foldable portion including the first end of the respective main panel.

13. The construct of claim 11, wherein the first end panel and the second panel are adapted to be folded toward the interior space to substantially close the second end of the construct.

14. The construct of claim 11, wherein the microwave energy interactive element comprises a susceptor, a foil, a segmented foil, or any combination thereof.

15. The construct of claim 11, wherein the microwave energy interactive element comprises a susceptor, and the susceptor overlies substantially all of the first main panel, second main panel, first minor panel, and second minor panel on the side of the respective panel facing the interior space.

16. A construct for heating, browning, and/or crisping a food item, comprising:

a plurality of panels joined to one another to define an interior space, each of the panels having a first end, a second end, and a first dimension measured from the first end to the second end, the plurality of panels including a pair of major panels, the first end of the major panels being opposite one another to define an opening, and a pair of minor panels opposite one another, the minor panels being joined to the major panels along respective tear lines to define the interior space, wherein the first dimension of the minor panels is greater than the first dimension of the major panels, such that a portion of each minor panel extends past the opening and defines a pair of tabs; and a microwave energy interactive element overlying at least a portion of at least one of the adjoined panels on a side of the respective panel facing the interior space.

17. The construct of claim 16, further comprising a fold line extending across at least one of the major panels substantially between the first minor panel and the second minor panel, the fold line defining a foldable portion including the first end of the respective major panel.

18. The construct of claim 16, further comprising a pair of end panels respectively foldably joined to the second end of the major panels.

19. The construct of claim 18, wherein the end panels are foldably joined to the major panels along respective arcuate fold lines.

20. The construct of claim 18, wherein the end panels are adapted to be folded toward the interior space in a superposed configuration to at least partially close the second end of the construct.

21. The construct of claim 16, wherein the microwave energy interactive element comprises a susceptor, a foil, a segmented foil, or any combination thereof.

22. The construct of claim 16, wherein the microwave energy interactive element comprises a susceptor, and the susceptor overlies a side of the major panels and the minor panels facing the interior space.

23. A blank for forming a microwave heating construct, comprising:

a plurality of adjoined panels, each panel having a first dimension extending in a first direction and a second dimension extending in a second direction substantially perpendicular to the first direction, the plurality of adjoined panels including a first panel, a second panel and a third panel respectively joined to opposite edges of the first panel, and a fourth panel joined to the second panel, wherein the first panel, second panel, third panel, and fourth panel are joined respectively to one another along a plurality of respective substantially parallel tear lines extending in the first direction; and a microwave energy interactive element overlying at least a portion of at least one of the first panel, second panel, third panel, and fourth panel, the microwave energy interactive element being operative for converting at least a portion of microwave energy into thermal energy, wherein the first panel and fourth panel each have an edge extending in the second direction, the respective edges of the first panel and fourth panel being substantially aligned with one another, and the first dimension of the second panel and the first dimension of the third panel are greater than the first dimension of the first panel and the first dimension of the fourth panel, such that a portion of each of the second panel and third panel extends in the first direction beyond the edge of the first panel and fourth panel.

24. The blank of claim 23, wherein the respective portion of the second panel and third panel that extends beyond the edge of the first panel and fourth panel has a substantially curved end.

25. The blank of claim 23, further comprising a fold line extending in the second direction substantially across the first panel, second panel, third panel, and fourth panel.

26. The blank of claim 23, wherein the plurality of adjoined panels further includes an end panel joined to the first panel.

27. The blank of claim 26, wherein the end panel is joined to the first panel along a substantially arcuate fold line.

28. The blank of claim 23, wherein the plurality of adjoined panels further includes a fifth panel joined to the third panel along a tear line extending in the first direction.

29. The blank of claim 28, wherein the plurality of adjoined panels further includes a first partial end panel joined to the fourth panel along a first curved fold line, and a second partial end panel joined to the fifth panel along a second curved fold line.

30. A microwave heating construct comprising:

a first pair of panels opposite one another, the first pair of panels each having a first end at least partially defining an opening at a first end of the construct, and a second end at a second end of the construct;

a second pair of panels opposite one another, the second pair of panels being joined to the first pair of panels along respective tear lines to at least partially define an interior space, the second pair of panels extending upwardly from the opening to define a pair of tabs;

a pair of end panels joined to the second end of the first pair of panels along respective arcuate fold lines, the end panels being operative for at least partially closing the second end of the construct; and a microwave energy interactive element joined to at least a portion of at least one panel of the first pair of panels and the second pair of panels on a side of the respective panel facing the interior space, the microwave energy interactive element being operative for converting at least a portion of microwave energy to thermal energy.

31. The construct of claim 30, further comprising a fold line extending across at least one panel of the first pair of panels substantially between the second pair of panels, the fold line defining a foldable portion including the first end of the respective panel of the first pair of panels.

32. The construct of claim 30, wherein the microwave energy interactive element is further joined to the end panels.

33. The construct of claim 30, wherein the microwave energy interactive element comprises a susceptor, a foil, a segmented foil, or any combination thereof.

34. A microwave heating construct comprising:

a plurality of adjoined panels defining an interior space, each of the panels having a first end edge, a second end edge opposite the first end edge, and a length measured from the first end edge to the second end edge, the plurality of panels including a first pair of panels opposite one another, the first end edge of each panel of the first pair of panels at least partially defining an opening, and a second pair of panels opposite one another, each panel of the second pair of panels being joined to the first pair of panels along respective tear lines, the length of the second pair of panels being greater than the length of the first pair of panels, such that a portion of each panel of the second pair of panels extends beyond the first end edge of the first pair of panels; and a microwave energy interactive element joined to at least a portion of at least one of the adjoined panels on a side of the respective panel facing the interior space.

35. The construct of claim 34, further comprising a fold line extending across at least one panel of the first pair of panels substantially between the second pair of panels, the fold line defining a foldable portion including the first end edge of the respective panel of the first pair of panels.

36. The construct of claim 34, further comprising a pair of end panels joined to the second end edge of the first pair of panels.

37. The construct of claim 36, wherein the end panels are foldably joined to the first pair of panels along respective curved fold lines.

38. The construct of claim 36, wherein the end panels are adapted to be folded towards the interior space.

39. The construct of claim 36, wherein the microwave energy interactive element is further joined to the end panels.

40. The construct of claim 34, wherein the microwave energy interactive element comprises a susceptor, a foil, a segmented foil, or any combination thereof.

* * * * *